US007370619B2

(12) United States Patent
Berger

(10) Patent No.: US 7,370,619 B2
(45) Date of Patent: May 13, 2008

(54) STARTER SYSTEM FOR INTERNAL COMBUSTION ENGINE

(75) Inventor: Alvin H. Berger, Brownstown, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/532,119

(22) Filed: Sep. 15, 2006

(65) Prior Publication Data

US 2008/0066707 A1 Mar. 20, 2008

(51) Int. Cl.
*F02N 17/00* (2006.01)

(52) U.S. Cl. ..... 123/179.25

(58) Field of Classification Search ..... 123/179.25
See application file for complete search history.

(56) References Cited

U.S. PATENT DOCUMENTS 1,364,854 A * 1/1921 Hartford ..... 123/179.25
1,730,220 A * 10/1929 Lansing ..... 123/179.28
2,024,659 A * 12/1935 Nardone ..... 123/179.29
3,219,021 A 11/1965 Mercer et al.
3,331,363 A * 7/1967 Holton, Jr. ..... 123/179.26
4,930,467 A * 6/1990 Masuda et al. ..... 123/179.24
5,072,627 A 12/1991 Horiye et al.
5,959,385 A * 9/1999 Kato et al. ..... 310/112
6,460,671 B1 10/2002 Karambelas et al.
6,758,181 B2 7/2004 Iida et al.
6,904,889 B2 * 6/2005 Matsuda et al. ..... 123/198 A

FOREIGN PATENT DOCUMENTS

FR 602258 3/1926

* cited by examiner

*Primary Examiner*—Hai Huynh
*Assistant Examiner*—Arnold Castro
(74) *Attorney, Agent, or Firm*—Diana Brehob; Dickinson Wright PLLC

(57) ABSTRACT

A starter system for a reciprocating internal combustion engine includes an input gear journaled for rotation upon a crankshaft in the engine, and a starter motor which applies a starting torque to an outer periphery of the input gear. A speed-sensitive clutch is interposed between the crankshaft and the input gear. The clutch selectively transmits torque between the input gear and the crankshaft by means of a series of pawls which are responsive to centrifugal force.

8 Claims, 4 Drawing Sheets

STARTER SYSTEM FOR INTERNAL COMBUSTION ENGINE

BACKGROUND OF THE INVENTION

1. Field of the Invention

The present invention relates to a starter motor and accompanying gear mechanism for cranking an internal combustion engine, such as a reciprocating internal combustion engine.

2. Disclosure Information

Internal combustion engines, particularly automotive internal combustion engines, have been equipped with electric self-starters since pioneering work by Charles Kettering led to the first automotive self-starter in 1912. As typically applied to automotive internal combustion engines, and, for that matter to most internal combustion engines, the self-starter uses a large diameter ring gear and a starter motor having an axis which is generally parallel to the engine's crankshaft. The starter motor is equipped with a spur gear that is driven into contact with the flywheel/ring gear by means of a solenoid. Unfortunately, conventional starters are noisy for a variety of reasons. First, the gears are unlubricated. As another source of noise, the gears are generally not enclosed within a case that is capable of muting sound generated by the gears.

A more troublesome drawback to present starting systems using large diameter ring gears is that the profile of the engine is adversely affected (e.g., made overly large). This presents a problem to vehicle designers because a large diameter ring gear prevents the engine from being moved farther down in a vehicle, thereby inhibiting efforts to produce more aerodynamic, fuel efficient vehicles.

A starter system according to the present invention uses a worm gear and worm drive system, including an input gear which is journaled for rotation, including relative rotation, to the engine's crankshaft. U.S. Pat. No. 6,758,181 discloses a worm gear starter system which, although being useful for a small one cylinder engine, as witnessed by the fact that the starter of the '181 patent has a rope handle, as well as an electro-drive, is not useful for an automotive engine because it must be cantilevered from one end of the engine, and is therefore not amenable to packaging within an automotive engine requiring a front-end accessory drive, nor would it be expected to exhibit the durability characteristics needed for an automotive engine starter system.

SUMMARY OF THE INVENTION

A starter system for a reciprocating internal combustion engine includes an input gear journaled for rotation upon a crankshaft of the engine. The input gear is preferably a unitary gear including a hub journaled for rotation upon the engine's crankshaft, and a clutch driving member circumscribing an outer portion of the hub and defining an inner wall of an annular clutch cavity. An outer portion of the unitary input gear is configured as a worm gear. This outer portion defines an outer wall of the previously described annular clutch cavity. A starter motor applies a starting torque to the outer portion of the input gear, preferably by means of a worm which is coaxial with the starter motor, with the axes of both the starter motor shaft and the worm being in the plane of the worm gear and perpendicular in a plan view, to the center axis of the engine's crankshaft.

The present starter system also includes a speed-sensitive clutch which is interposed between the crankshaft and the input gear. This speed-sensitive clutch includes a generally annular pawl carrier rigidly mounted to a counterweight of the crankshaft and carrying a number of pawls for engaging a number of clutch abutments formed in the clutch driving member. The pawl carrier functions as the clutch driven member. Each of the pawls is responsive to centrifugal force such that torque will be transmitted between the input gear and the crankshaft only if the rotational speed of the crankshaft is below a threshold value. The clutch driven member is housed within an annular clutch cavity which is defined in the unitary input gear. In general, the unitary input gear, as noted above, includes a hub journaled for rotation upon the engine's crankshaft, and a clutch driving member which circumscribes an outer portion of the hub and defines an inner wall of the annular clutch cavity. An outer portion of the unitary input gear, configured as a worm gear, defines an outer wall of the annular clutch cavity.

The worm portion of the present starter system may be mounted within a main bearing cap of the engine, which may comprise either a rear main bearing cap or front main bearing cap of the engine or, for that matter, a middle main bearing cap, if the end counterweights are designed to be removable so that during assembly the end portion of the crankshaft can fit through the inner diameter of the starter mechanism.

It is an advantage of a starter system according to the present invention that the starter operates quietly because all parts of the starter may be lubricated, including the worm gear and worm. Quiet operation is also promoted by the fact that the worm gear and worm interface is inherently quiet, and the meshing parts are contained within a completely enclosed portion of the engine.

It is a further advantage of a starter system according to the present invention that the engine's vertical height, as well, in certain cases, as the engine's length, may be reduced by use of the present starting system.

It is a further advantage of a starter system according to the present invention that it is not possible to damage the present starting system by energizing the starter motor after the engine has accelerated above its cranking speed.

Other advantages, as well as features of the present invention, will become apparent to the reader of this specification.

BRIEF DESCRIPTION OF THE DRAWINGS

FIG. 3 illustrates the present starter system in a cranking mode.

DETAILED DESCRIPTION OF THE PREFERRED EMBODIMENTS

Figure 1:
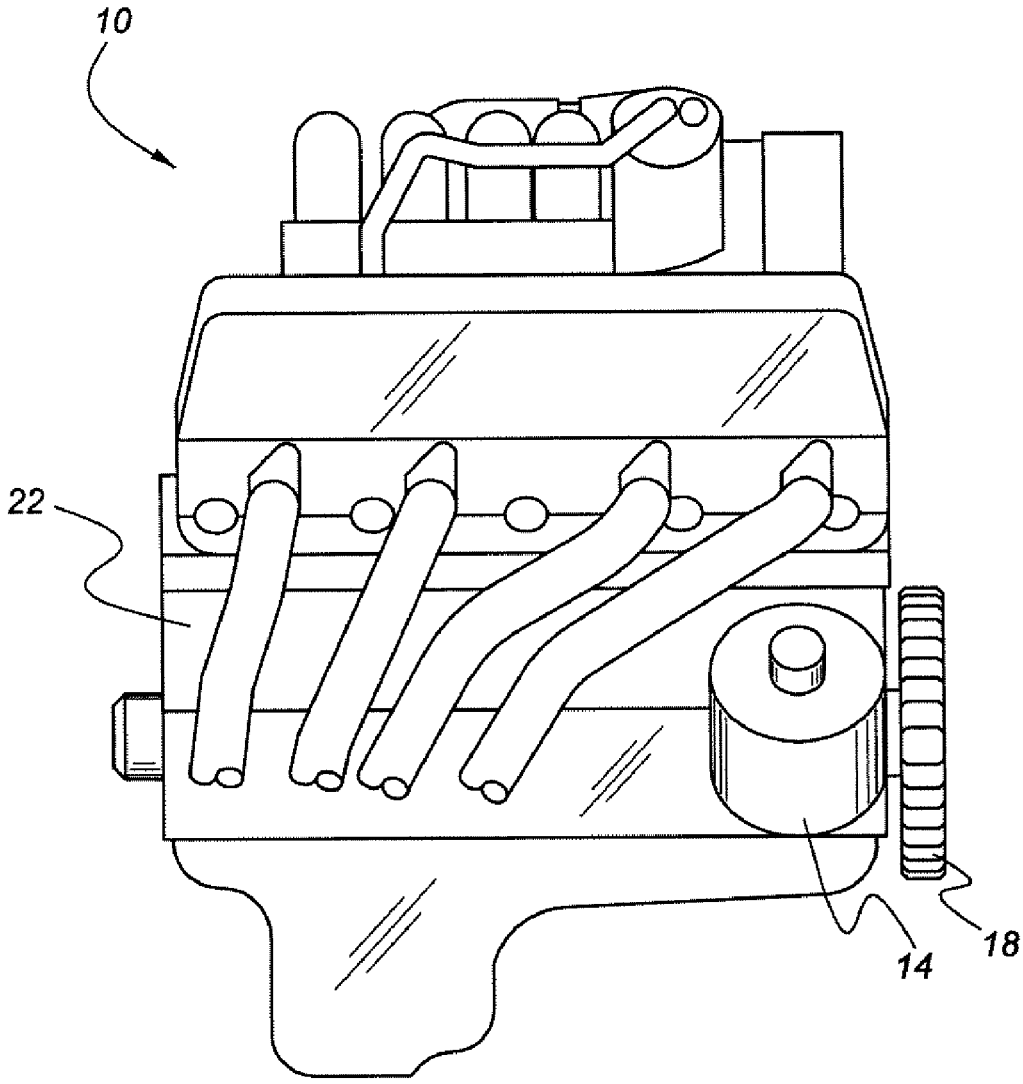
FIG. 1 is a side elevation of an engine having a starting system according to the present invention.

As shown in FIG. 1, engine 10, having crankshaft 18, is started by means of starter 14. It is easily seen from FIG. 1, as well as the other figures in the specification, that the shaft axis of starter motor 14 is in a plane which is perpendicular to the center axis of crankshaft 18.

Figure 2:
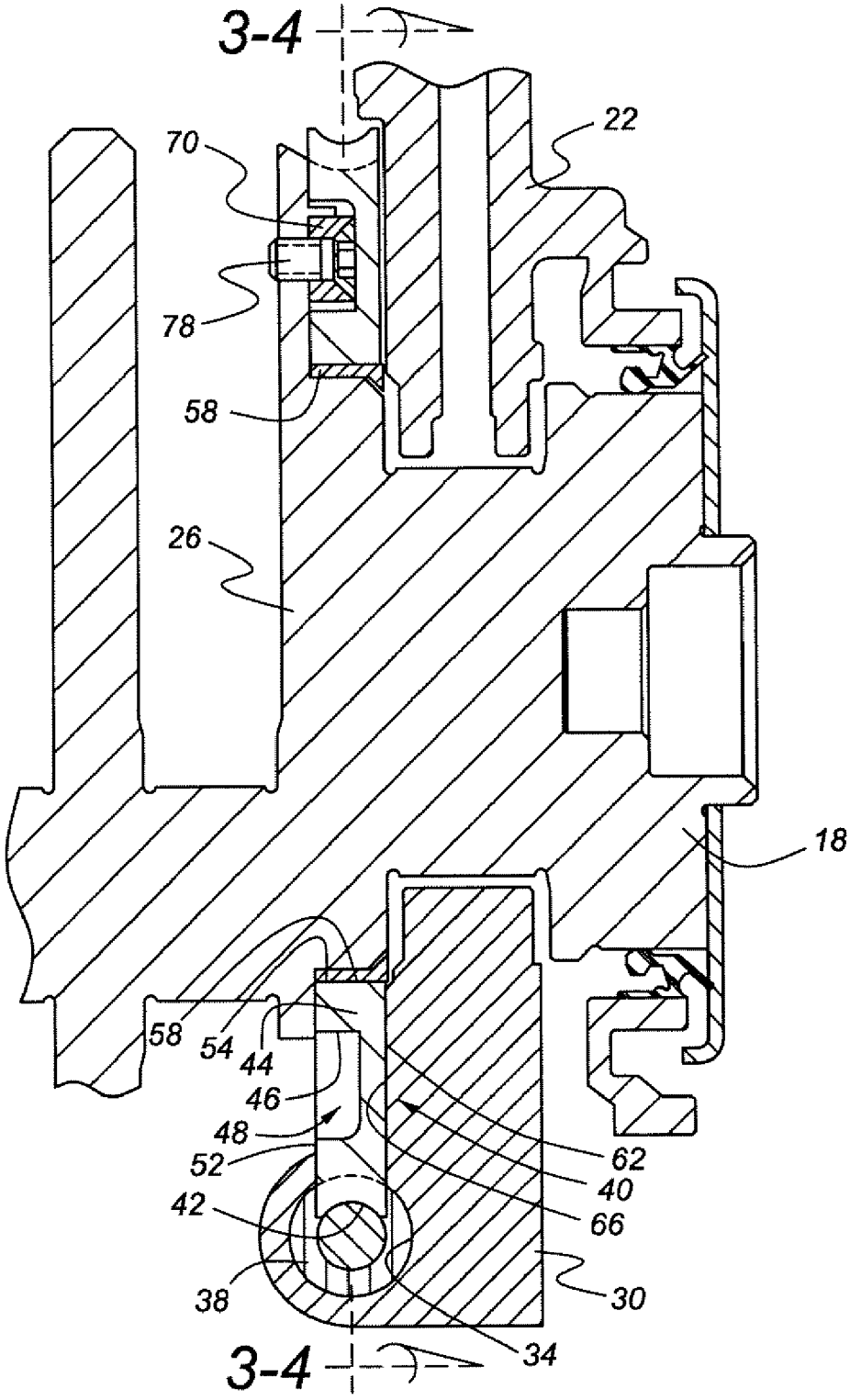
FIG. 2 is a sectional view of the engine of FIG. 1, taken along the line 2-2 of FIG. 3.
Figure 3:
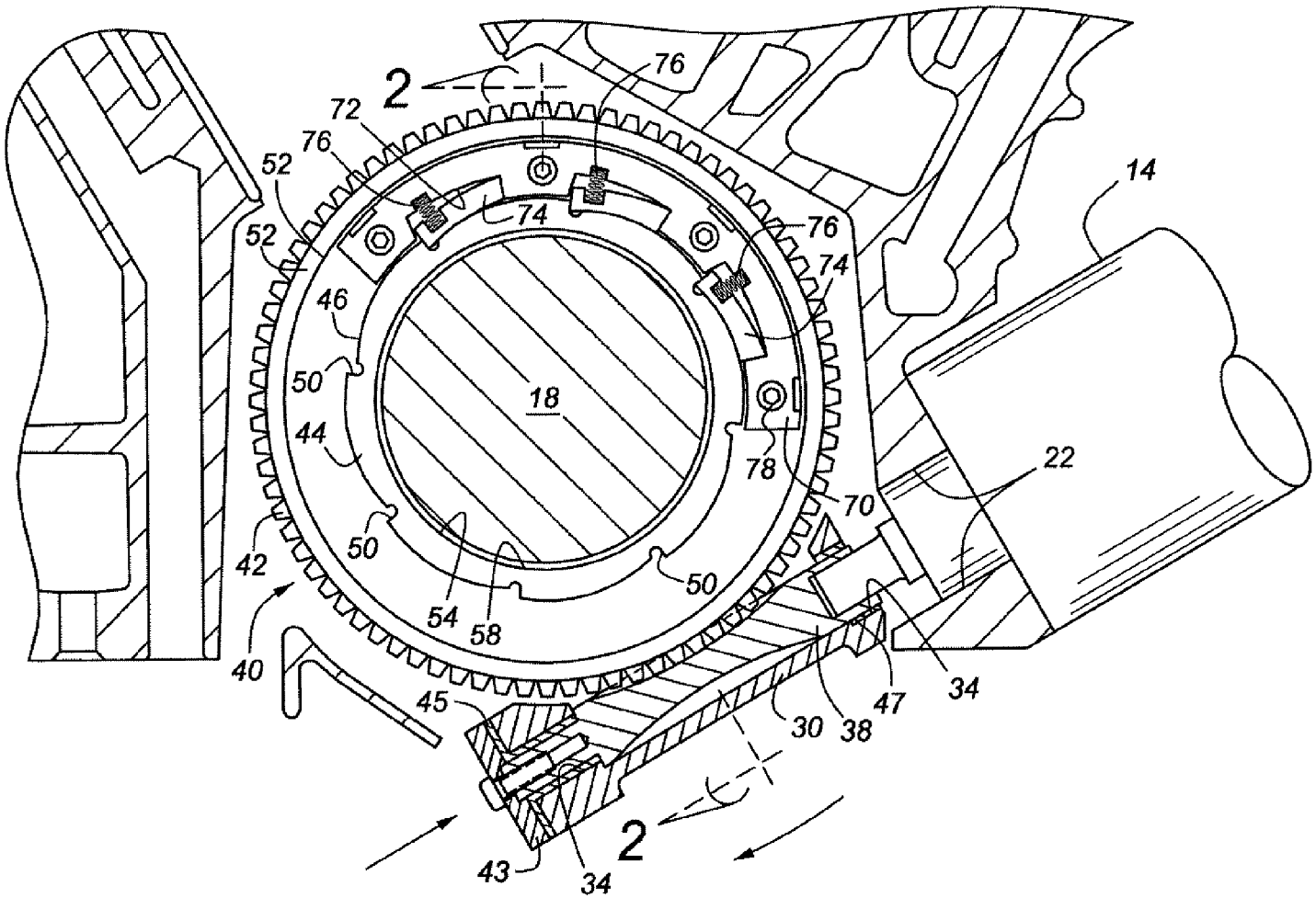
FIG. 3 is an end section of the engine of FIGS. 1 and 2, taken along the line 3-4 of FIG. 2.

Turning now to FIGS. 2 and 3, starter motor 14 is shown in FIG. 3 as being attached to cylinder block 22. Starter motor 14 drives worm 38, which is mounted within bore 34 formed in main bearing cap 30. As shown in FIG. 2, main bearing cap 30 performs not only the traditional function of mounting crankshaft 18 within engine 10, but also has, as noted above, integral bore 34 within which worm 38 is mounted. As shown in FIG. 3, worm 38 is mounted by means of bushings 45 and 47. Thrust washer 43 accommodates the thrust load imposed upon worm 38 by the remainder of the gear train used in the present starting system.

Input gear 40 is at the heart of the present starter system. As shown in FIGS. 2 and 3, input gear 40 has an inner bore, 54, which houses bushing 58. Bushing 58 rides directly upon crankshaft 18 and allows input gear 40 to rotate freely with respect to crankshaft 18, except when the clutch portion of the present device is engaged. This is important because input gear 40 must be free to allow crankshaft 18 to rotate freely when engine 10 has been started.

Figure 4:
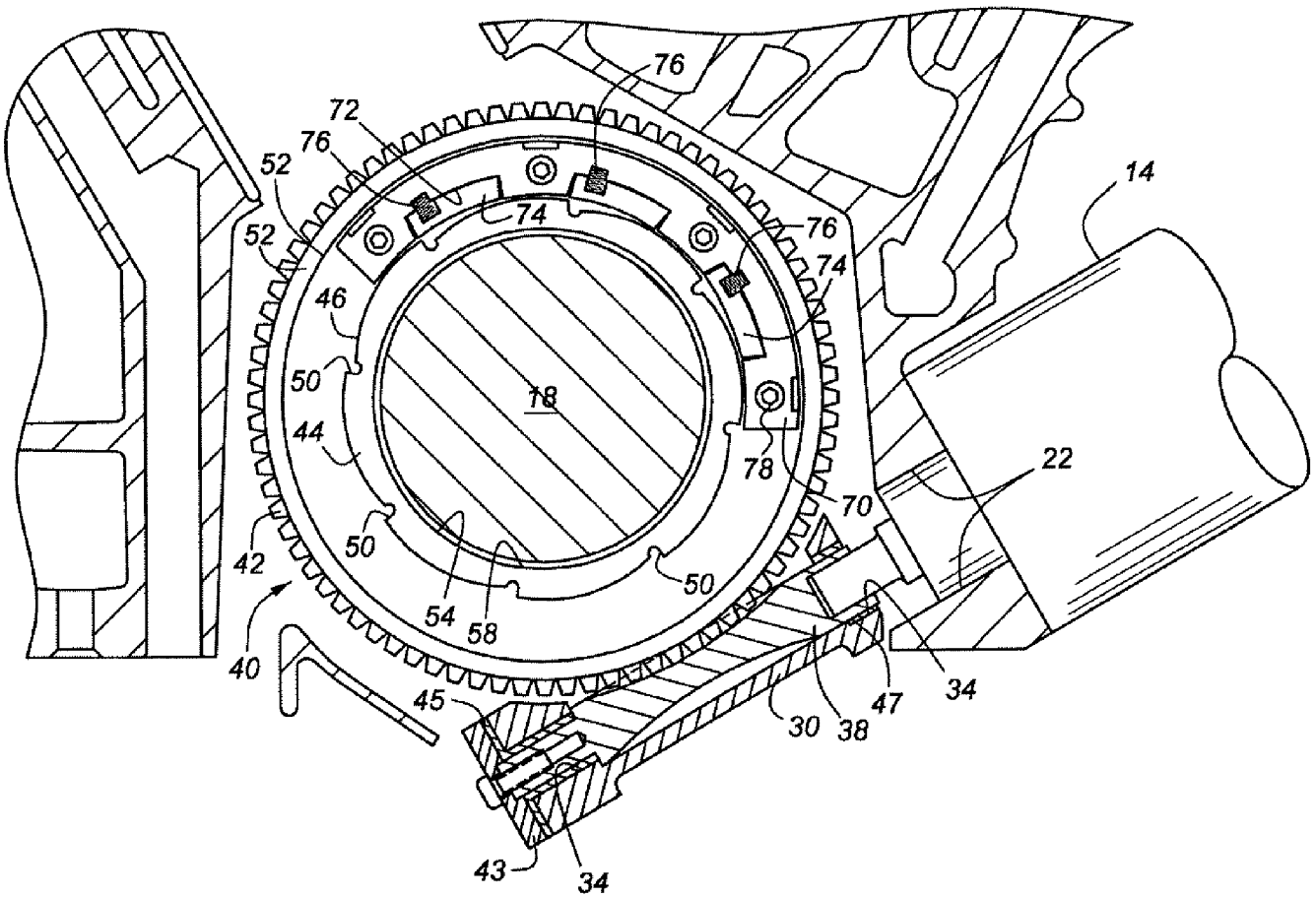
FIG. 4, although similar to FIG. 3, illustrates the present starter system in an engine run mode in which the engine speed has increased above a predetermined threshold.

Moving outward from bore 54, it is seen from FIGS. 3 and 4 that input gear 40 has an inner portion serving as a clutch driving member, 46. Clutch driving member 46 has a number of clutch abutments, 50, formed thereupon. Clutch driving member 46 circumscribes an outer portion of hub 44, and in so doing defines an inner wall of an annular clutch cavity, 48 (FIG. 2). The outer wall of clutch cavity 48 is formed by the base of worm gear 42, which is formed on the outer periphery of input gear 40. Worm gear 42 meshes with worm 38, and in so doing rotates clockwise when starter motor 14 is energized. Note that there is no clutch or other disengagement mechanism between starter motor 14 and worm 38; thus, whenever starter motor 14 has been energized, worm 38 and input gear 40 will turn, regardless of engine speed. This eliminates the need for a conventional engage and disengage gearset arrangement needed to couple most known starter motors to an engine's flywheel or flexplate.

The task of selectively transmitting torque between input gear 40 and crankshaft 18 falls in large part upon pawl carrier 70 and its associated hardware. Pawl carrier 70 includes a generally annular body which is bolted to crankshaft counterweight 26 by means of a number of bolts, 78. Several pawls, 74, are mounted within notches, 72, formed in pawl carrier 70. The purpose of pawls 74 is to transmit torque between input gear 40 and ultimately, crankshaft 18, but only if the rotational speed of crankshaft 18 is below a threshold value, which may be set at a speed slightly in excess of the design cranking speed of engine 10.

As noted above, FIG. 3 illustrates the present device in a cranking mode characterized by rotation of the engine crankshaft in a clockwise direction. Accordingly, each of pawls 74 is engaged between one of clutch abutments 50 formed on clutch driving member 46, and a corresponding portion of pawl carrier 70. Once engine 10 starts, centrifugal force will drive pawls 74 radially outward against the force of springs 76, allowing the present starter mechanism to become disengaged from crankshaft 18. Crankshaft 18 will then be free to rotate within bushing 58. When pawls 74 are disengaged, crankshaft 18 may move axially without restraint other than that imposed by the usual thrust bearing feature. In a preferred embodiment, springs 76 are selected to have a low "k" value so that when pawls 74 move radially outward, the outwardly directed centrifugal force acting upon the pawls increases more rapidly than the restoring force provided by springs 76. In this manner, the hysteretic effect which is developed will help to avoid unwanted cyclical engagement/disengagement of pawls 74.

The configuration of input gear 40 allows the incorporation of a relatively large thrust surface, 62, which interfaces with a corresponding thrust surface, 66, formed on main bearing cap 30. This controls the axial position of input gear 40.

Those skilled in the art will appreciate in view of this disclosure that an engine using the present starter may need to be rebalanced because a crankshaft counterweight must be modified to provide space for the cranking mechanism. Those skilled in the art will further appreciate that pawl carrier 70 may be either bolted with fastener 78 or welded to the crankshaft or attached by other means.

While particular embodiments of the invention have been shown and described, numerous variations and alternate embodiments will occur to those skilled in the art. Accordingly, it is intended that the invention be limited only in terms of the appended claims.

What is claimed is:

1. A starter system for a reciprocating internal combustion engine, comprising:

an input gear journaled for rotation upon a crankshaft of said engine;

a starter motor for applying a starting torque to an outer periphery of said input gear with said starter motor driving a worm having an axis in a plane which is perpendicular to the center axis of said crankshaft; and a speed-sensitive clutch, interposed between said crankshaft and said input gear, for selectively transmitting torque between said input gear and said crankshaft wherein said input gear comprises an outer portion configured as a worm gear and an inner portion comprising a driving member of said speed-sensitive clutch.

2. A starter system according to claim 1, wherein said starter motor and said worm have a common center axis which is in a plane perpendicular to the center axis of said crankshaft.

3. A starter system according to claim 1, wherein said input gear further comprises an axial thrust surface for engaging a mating thrust surface provided upon a main bearing cap mounted adjacent said input gear.

4. A starter system according to claim 1, wherein said speed-sensitive clutch comprises a driving member comprising a portion of said input gear, and a driven member comprising a generally annular pawl carrier rigidly mounted to said crankshaft and carrying a plurality of pawls for engaging a plurality of clutch abutments formed on said driving member, with each of said pawls being responsive to centrifugal force.

5. A starter system according to claim 4 wherein said pawl carrier is attached to a counterweight of said crankshaft.

6. A starter system according to claim 1, wherein said worm is mounted within a main bearing cap of said engine.

7. A starter system according to claim 6, wherein said worm is mounted within a rear main bearing cap of said engine.

8. A starter system according to claim 6, wherein said worm is mounted within a front main bearing cap of said engine.

* * * * *